United States Patent [19]

Fast

[11] Patent Number: 4,787,159

[45] Date of Patent: Nov. 29, 1988

[54] LABEL HOLDER FOR DISPLAYING PRODUCT INFORMATION

[76] Inventor: Jacob Fast, 7561 NW. 9th St., Plantation, Fla. 33317

[21] Appl. No.: 5,908

[22] Filed: Jan. 21, 1987

[51] Int. Cl.[4] ..... G09F 3/18

[52] U.S. Cl. ..... 40/642

[58] Field of Search ..... 40/10 R, 2 R, 11 R, 40/20 R, 195; 403/405; 24/683, 698; 248/220.4

[56] References Cited

U.S. PATENT DOCUMENTS

| | | | |
|---|---|---|---|
| 2,857,696 | 10/1958 | Barrow | 40/11 R |
| 3,707,049 | 12/1972 | Thalenfeld | 40/10 R |
| 3,728,806 | 4/1973 | Kostiuk | 40/11 R |
| 3,824,720 | 7/1974 | Langwell | 40/10 R |
| 4,463,510 | 8/1984 | Windish | 40/2 R |
| 4,512,541 | 4/1985 | Lietzke | 248/459 |
| 4,583,308 | 4/1986 | Taub | 40/19.5 |

FOREIGN PATENT DOCUMENTS

| | | | |
|---|---|---|---|
| 1454046 | 2/1969 | Fed. Rep. of Germany | 40/10 R |
| 9930 | of 1911 | United Kingdom | 40/11 R |

*Primary Examiner*—Gene Mancene
*Assistant Examiner*—Michael Lynch
*Attorney, Agent, or Firm*—Holman & Stern

[57] ABSTRACT

A label holder particularly for uswe on an elongate broom hook in a store display for providing product information in relation to brooms suspended from the hook is formed from a sheet of plastic material having an elongate strip element which is looped around the hook and secured thereto by self adhesion of a contact adhesive on one surface of the strip. The strip has a flange at one end that extends laterally from the hook and a label attachment with a label panel depends from the flange. The label provides a customer with substantially unobstructed vision of the product information and does not inpede access to brooms on the hook.

7 Claims, 1 Drawing Sheet

LABEL HOLDER FOR DISPLAYING PRODUCT INFORMATION

BACKGROUND OF THE INVENTION

Field of the Invention

This invention relates a label holder for displaying product information in connection with products suspended in supermarkets or other stores on horizontal elongate support hooks.

For example, it is common practice in supermarkets, hardware stores and the like to display brooms on elongate two-prong broom hooks which project horizontally from a perforated support board or the like, with the hook having a bracket or other attachment at its proximal end whereby the hook is secured to the board. A row of brooms may be suspended from such a hook in an inverted position with the broom heads spanning the hook prongs and the broomsticks extending downwardly between the prongs.

It is generally necessary with product displays of the above type to provide some form of labelling in association with the hook indicative of product price or providing other product information. Moreover, for optimal effect, it is desirable to provide such labelling at or near the distal end of the hook rather than at its proximal end where a label may, for example, be obscured from customer view by the products themselves. Moreover, with broom hooks, it may be impractical to provide a label holder of the type which extends front to back over the length of the hook, because of the presence of the broom heads above the hook prongs. The present invention accordingly provides an alternative approach to this type of labelling.

SUMMARY OF INVENTION

It is an object of the invention to provide a novel form of label holder which can be readily manufactured from plastic sheet material for use in association with an elongate product support hook, such as a broom hook, for the display of product information at or near a distal end of the hook. While the invention finds particular application to broom hooks, it is understood that it is not limited thereby and is applicable to other types of an elongate hooks and the like.

Another object of the invention is to provide a label holder as referred to above which can be attached to a elongate support hook at or near its distal end, so as to extend laterally from one side of the hook whereby, at least in the case of broom hooks, the label provides substantially no obstruction to removal of articles from the hook, and is not itself disturbed by removal of the articles, while providing a substantially unobstructed view of product information contained thereon.

Thus, a label holder in accordance with the invention comprises an elongate strip of plastic or like sheet material having contact adhesive on one surface, which may be covered prior to use with release paper, whereby the strip may be looped around an elongate hook prong or like member and secured to the prong by self adhesion between opposite end sections of the strip, and the strip further including a widened section or flange at one end providing a suport element, positioned to one side of the prong when the strip is secured as aforesaid, for a fold-down label holding panel.

Preferably in accordance with the invention the strip element of the label holder is secured around the prong or the like with the widened section at the bottom of the loop and accordingly label holders in accordance with the invention may be provided in left and right-hand versions. Alternatively, the strip may have widened sections at both ends or on opposite sides, so that it may be used to provide either a left or right-hand label holder.

Further, the fold-down label holding panel may be formed integrally with the widened section of the label holder or may be in the form of a separate attachment.

Additional features and advantages of the invention will become apparent from the following description and claims read in conjunction with the accompanying drawings.

DESCRIPTION OF PREFERRED EMBODIMENT

Figure 1:
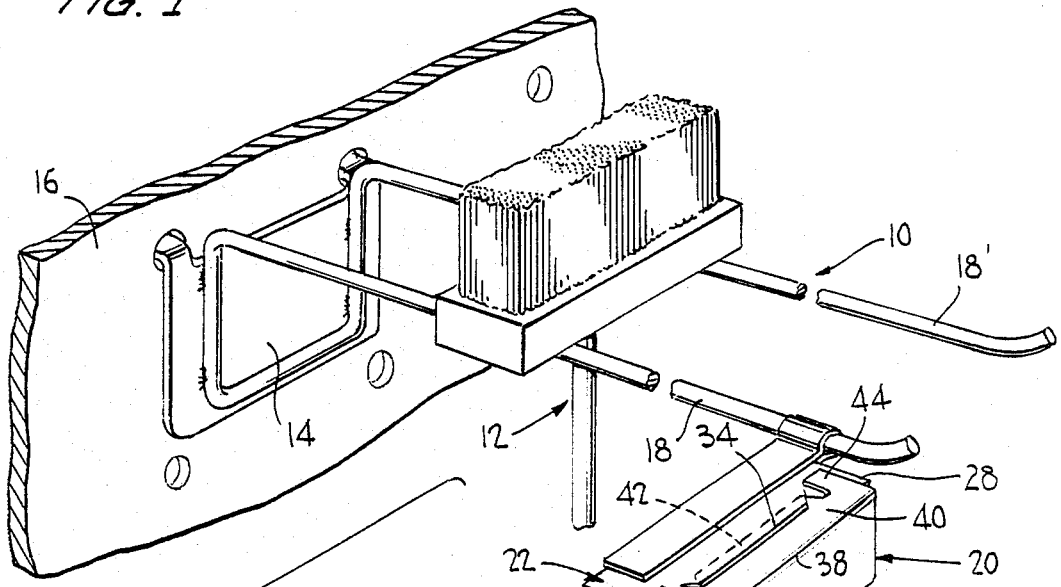
FIG. 1 is a perspective in-use view of a two-prong broom hook and attached left hand label holder in accordance with the invention.
Figure 2:
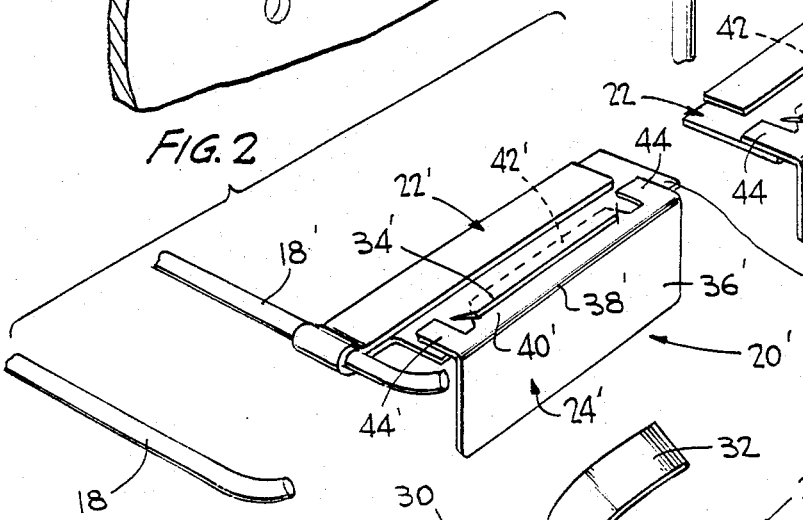
FIG. 2 is a view similar to FIG. 1 of a distal end portion of the hook with an attached right hand label holder in accordance with the invention.

Referring initially to FIGS. 1 and 2, there is illustrated a conventional form of broom hook 10 for displaying brooms 12 in a supermarket, hardware store or the like. The hook has a bracket 14 at its proximal end for supporting the hook cantilever-wise from a perforated board 16, and pair of elongate prongs 18, 18' extending from the bracket. Brooms may be suspended from the hook in the manner shown in FIG. 1 with the broom heads supported by and spanning the prongs, and with the broomsticks extending down between the prongs. FIG. 1 shows a left-hand label holder 20 according to the invention attached to left-hand prong 18 adjacent its distal end for the display of product information, and FIG. 2 shows an alternative right-hand label holder holder 20' similar to label holder 20 adjacent the distal end of right-hand prong.

Figure 3:
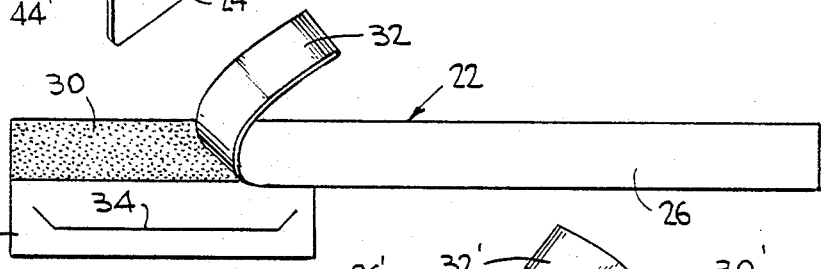
FIG. 3 is a plan view of a part of the label holder shown in FIG. 1 prior to use.
Figure 4:
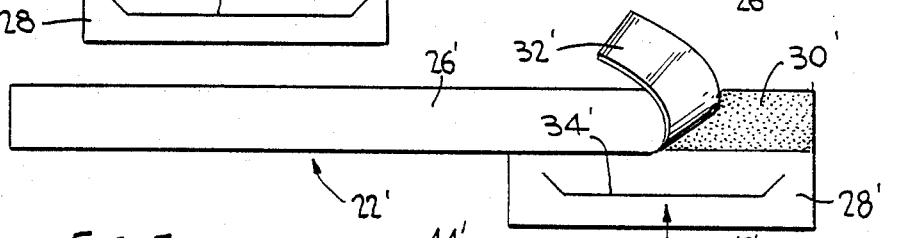
FIG. 4 is an exploded plan view of the label holder shown in FIG. 2 prior to use.

Label holders 20, 20' may be formed from suitable plastic sheet well known for the purpose and may comprise respective body parts 22, 22' and respective label holding attachments 24, 24'. The body parts 22, 22' (FIGS. 3 and 4) have respective elongate strip elements 26, 26' with widened sections or flanges 28, 28'' at one end. For example, the strip elements may have an overall length of about five and a quarter inches, and a width of about one half inch. The flanges may have a length of about two inches a the width of about one half inch. The flanges may have a length of about two inches and the width of about one half inch. One surface of the respective strip elements, the upper surface as illustrated, is covered with suitable contact adhesive 30, 30' and a suitable release paper strip 32, 32'. The respective flanges 28, 28' are left free of adhesive and are formed with respective elongate arrowhead-type slits 34, 34' for securing of the respective label holding attachments 24, 24' as will be described.

The attachments 24, 24' have respective label panels 36, 36' (which may be printed with a label or may have an adhesive label applied thereto) separated by respective transverse bend lines 38, 38' from respective attachment panels 40, 40'. The attachment panels have respective arrowhead-like projections 42, 42' at one edge bounded by respective side tabs 44, 44'. Projections 42, 42' are complimentary to slits 34, 34' enabling the attachments to be secured to the respective flanges 28, 28' by sliding the respective projections from above into the respective slits. The tabs 44, 44' engage the upper surface of the respective flange preventing the attachment from tilting upwardly. Panels 36, 36' are bent down vertically about bends 38, 38' prime.

To attach a respective body part 22 or 22' to a prong of hook 10 the release paper 32, 32' is removed, the two ends of the respective strip element are brought together and adhered over a length of about one inch leaving the rest of the strip element as a loop of sufficient diameter to slide over the respective prong 18 or 18'. The loop is preferably slid onto the prong with flange 28 or 28' at the bottom and positioned as required along the prong with the flange substantially horizontal. The facing adhesive sections of the strip element are pressed together along their entire exposed length to tighten the loop around the prong and secure the body portion in place. The respective label holding attachment 24 or 24' may then be secured to the body portion as described above.

Figure 5:
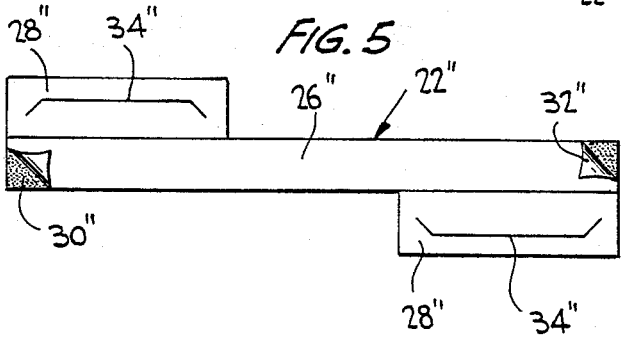
FIG. 5 is a plan view of part of a reversible label holder in accordance with the invention.
Figure 5:
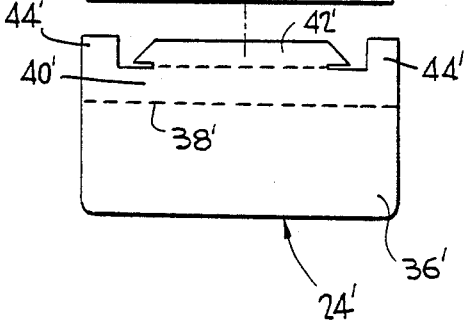

FIG. 5 shows a label holder body portion 22'' similar to portions 22, 22' insofar as it here has an elongate strip element 26'' with adhesive 30'' and release paper 32'' as previously. In this case, however, the strip element has a flange 28'' at each end so that it can be used either as a left or right-hand label holder.

In a further modification of the invention, a fold-down label holding panel equivalent to panels 36, 36' may be formed integrally with flange 28 or 28' where, for example, replacement labelling may not be required.

While only a preferred embodiment of the invention has been described herein in detail, the invention is not limited thereby and modifications may be within the scope of the attached claims.

I claim:

1. A label holder comprising an elongate strip of sheet material such as plastic, having contact adhesive on one surface whereby the strip may be looped around an elongate hook prong or the like and secured to the prong by self adhesion between opposite end sections of the strip, each of said end sections being provided with the contact adhesive the strip including a widened flange extending laterally from one of said end sections, said flange being substantially free of the adhesive and providing a support element for a fold-down label holding panel wherein the flange includes first attachment means for a separate label-holding attachment, the holder further including the separate holding attachment formed of sheet material which includes the fold down panel and second attachment means engageable with the first attachment means for releasably securing the attachment to the flange, wherein the first attachment means comprises a slit in the flange and the second attachment means comprises a headed formation on the label holding attachment engageable in the slit, and wherein the headed formation on the attachment is bounded by tab means for engaging an upper surface of the flange and preventing upward tilting of the attachment.

2. The invention of claim 1 wherein the flange is replicated at the end section of the strip opposite said one end section.

3. In combination with an elongate prong of a support hook for a product display, the support hook having proximal end mounting means for attachment to a vertical support with the prong extending forwardly from said mounting means, a label holder of sheet material including an elongate strip looped around a section of the prong forwardly of the mounting means to extend laterally from the prong with opposite end portions of the strip being adhered together by contact adhesive on the surface of the strip, the strip including a widened flange extending laterally from one of said end portions and the holder further including a label panel folded down from the flange parallel to the strip.

4. The invention of claim 3 wherein the label panel forms part of a label holding attachment which can be detached from the flange.

5. The invention of claim 4 including attachment means between the flange and the label holding attachment comprising a slit in the flange and a complimentary headed projection on the attachment engaged in the slit.

6. The invention of claim 5 including tab means on the attachment adjacent to the headed projection, the tab means engaging in the upper surface of the flange to preclude upward tilting of the attachment.

7. The invention of claim 3 wherein the flange extends from a bottom leg of the strip.

* * * * *